United States Patent [19]

Suzuki et al.

[11] 4,446,907

[45] * May 8, 1984

[54] DIE-CASTING METHOD

[75] Inventors: Haruo Suzuki, Aichi; Shigeyoshi Hashimoto, Anjo, both of Japan

[73] Assignee: Nippondenso Co., Ltd., Kariya, Japan

[ * ] Notice: The portion of the term of this patent subsequent to Apr. 19, 2000 has been disclaimed.

[21] Appl. No.: 266,014

[22] PCT Filed: Feb. 14, 1979

[86] PCT No.: PCT/JP79/00034

§ 371 Date: Oct. 14, 1980

§ 102(e) Date: May 22, 1979

[87] PCT Pub. No.: WO80/01657

PCT Pub. Date: Aug. 21, 1980

[51] Int. Cl.[3] ..... B22D 18/02

[52] U.S. Cl. ..... 164/120

[58] Field of Search ..... 164/113, 120, 312–318

[56] References Cited

U.S. PATENT DOCUMENTS 3,106,002 10/1963 Bauer .

FOREIGN PATENT DOCUMENTS 51-130631 11/1976 Japan .
51-129817 11/1976 Japan .
52-77826 6/1977 Japan .

*Primary Examiner*—Kuang Y. Lin
*Attorney, Agent, or Firm*—Cushman, Darby & Cushman

[57] ABSTRACT

The present invention relates to a die-casting method in which a molten metal is injected through a runner (31) into a die cavity (30) for casting an article and the injected metal is squeezed also from a squeezing passage (17) by a squeeze plunger (36). The squeeze passage is communicated with the die cavity (30) at a portion thereof where the die cavity is communicated with the runner (31). The invention is characterized in that, on squeezing, the molten metal is displaced from the squeeze passage (17) while forming a divergent flow, to thereby assure that squeezing operations are carried out always at a stable squeezing pressure. The invention is also characterized in that, of the portion of a die-cast body which has been solidified in the die cavity (30), the part opposed by the squeeze passage (17) is removed by cutting with a cross-sectional area greater than that of the squeeze passage and in the direction of movement of the squeeze plunger, so that the part of a die-cast body which tends to include surface defects and segregation which would adversely affect the mechanical strength and workability of the die-cast body is removed therefrom and, in addition, the bore or groove formed as a result of the cutting can advantageously be used as a part of the outer profile of the final product. The method of the invention can effectively be used in the mass-production of articles which are intended for use under a high pressure or articles which have to be worked precisely. For instance, the die-casting method of the invention can suitably be used in the production of compressor and pump housings.

8 Claims, 10 Drawing Figures

100μ

100μ

100μ

DIE-CASTING METHOD

TECHNICAL FIELD

The present invention relates to a die-casting method and, more particularly, to a die-casting method in which a molten metal is injected through a runner into a die cavity for casting an article and the molten metal in the die cavity is squeezed also through a squeeze passage by means of a squeeze plunger, the squeeze passage being communicated with the die cavity at a portion other than the portion where the runner is communicated with the die cavity.

BACKGROUND ART

Japanese Laid-open Patent Publication No. 51-129817 discloses a die-casting method in which the molten metal in a squeeze passage communicated with a die cavity at a portion other than the portion through which a runner is communicated with the die cavity is forcibly displaced by a squeeze plunger back into the die cavity. In the apparatus disclosed in Japanese Laid-open Patent Publication No. 51-129817, however, the squeeze passage has a shape as shown in FIG. 1 and the molten metal $\alpha$ in the squeeze passage displaced by the squeeze plunger 36 is restricted by a communication passage having a cross-sectional area smaller than that of the squeeze passage and, thereafter, is displaced back into the die cavity 30.

The present inventors conducted experiments with respect to this squeezing method. The test result showed that the force required for advancing the squeeze plunger was fluctuated over a wide range with a resultant difficulty to obtain a stably constant squeezing pressure. The present inventors considered that the fluctuation of the squeezing pressure encountered in the use of such an apparatus as shown in FIG. 1 was for the following reason. Namely, the moment at which the forward movement of the squeeze plunger 36 is started is inevitably delayed from the filling up of the squeeze passage 17 by a predetermined time period during which the surface of the molten metal $\alpha$ is solidified. Therefore, when the squeeze plunger 36 is advanced, the squeeze plunger 36 is required to displace also a solidified layer $\beta$ of the metal. It is considered that the solidified layer $\beta$ in the squeeze passage 17 is blocked by the communication passage 17*a* during the forward movement of the squeeze plunger 36 and is shorn in a quite complicated manner.

It is considered that the difficulty in obtaining a constant squeezing pressure acting on the molten metal $\alpha$ in the squeeze passage 17 is attributable to the fact that the resistance due to the shearing of the solidified layer $\beta$ during the forward movement of the squeeze plunger 36 is largely fluctuated.

DISCLOSURE OF THE INVENTION

On the basis of the above consideration, the present inventors have discovered a die-casting method in which the squeezing is effected in such a manner that the molten metal is displaced into the die cavity from a squeeze passage communicated with the die cavity at a portion other than the portion of the die cavity which is in communication with the runner while the displaced molten metal forms a diverging flow. More specifically, an apparatus in used in which the portion of the die cavity at which the latter is communicated with the squeeze passage has a cross-sectional area greater than that of the squeeze passage over the entire region in the direction of movement of the squeeze plunger, so that the molten metal displaced out of the squeeze passage into the die cavity forms a diverging flow. The squeeze is effected by such a diverging flow of molten metal.

The inventors have conducted experimental die-casting operations by the method in which the molten metal displaced from the squeeze passage flows divergently into the die cavity, with a result that the molten metal could be forced into the squeeze passage at a stable pressure.

However, it was found that surface defects and segregations are apt to be formed at the portion of the die cavity where the molten metal displaced from the squeeze passage flows divergently into the die cavity. Thus, it was confirmed that the die-cast articles produced by this method have inferior strength and workability at the portions of the articles which were solidified in the sections of the die cavity at which the die cavity was communicated with the squeeze passage.

The present invention has been derived from the above-stated results of research and has its object to effect a squeeze in such a manner that the molten metal displaced from the squeeze passage flows divergently into the die cavity to ensure a stable and constant squeezing effect on the metal in the die cavity, and cut away, from the die-cast body solidified in the die-cavity, the portion of the die-cast body which is apt to include surface defects and segregations, such as the portion of the die-cast body solidified in the squeeze passage.

In order to achieve the object, the present invention provides a method in which the following steps are carried out in sequence:

1. a first step of bringing a movable die into close contacting relationship to a fixed die so that these dies cooperate together to define a die cavity for casting an article therein, a runner through which a molten metal is injected into the die cavity and a squeeze passage communicated with the die cavity at a portion other than the portion at which the die cavity is communicated with the runner;

2. a second step of injecting the molten metal at a predetermined injection pressure through the runner into the die cavity and into the squeeze passage to fill up the die cavity and the squeeze passage with the molten metal;

3. a third step of applying a pressure to the molten metal in said squeeze passage to forcibly displace the molten metal therefrom into the die cavity in such a manner that the displaced molten metal forms a diverging flow;

4. a fourth step of removing the pressure from the molten metal in the squeeze passage after the metal in the die cavity is solidified;

5. a fifth step of moving the movable die away from the fixed die to remove a die-cast body solidified in the die cavity, in the runner and in the squeeze passage; and 6. a sixth step of removing from said die-cast body the portions thereof which have been solidified in the runner and in the squeeze passage and also removing, from the portion of the die-cast body solidified in the die cavity, the part of the die-cast body opposing the squeeze passage, the removal of said die-cast body part being effected with a cross-sectional area greater than the cross-sectional area of the squeeze passage and in the direction of movement of the squeeze plunger.

The method of the invention is advantageous in that the invention always assures a reliable squeezing to ensure mass-production of a large number of die-cast products which are free from voids or cavities which would adversely affect the gas-tightness and mechanical strength of the die-cast products. In addition, since the portion of a die-cast body which tends to include surface defects and segregations is cut and removed, the method of the invention can advantageously be used to die-cast articles which are intended for use under a high pressure and articles which must be precisely worked. Furthermore, since that part of the portion of die-cast body solidified in the die cavity which opposes the squeeze passage is cut away with a cross-sectional area greater than the cross-sectional area of the squeeze passage and in the direction of movement of the squeeze plunger, the recess or groove formed as a result of the cutting can directly be used as a part of the outer profile of the product.

BRIEF DESCRIPTION OF DRAWINGS

FIGS. 3 and 4 are sectional views showing a squeeze passage 17, a die cavity 30 and a molten metal accumulation space 32 of the apparatus shown in FIG. 2, wherein FIG. 3 shows a squeeze plunger 36 in its fully retracted position while FIG. 4 shows the squeeze plunger 36 in its fully advanced position;

BEST MODE FOR CARRYING OUT THE INVENTION

The most preferred embodiment of the invention will be described hereinafter. An explanation will be made first with respect to the apparatus for use in carrying out the method of the invention, with reference to an illustrated example of the apparatus.

Figure 2:
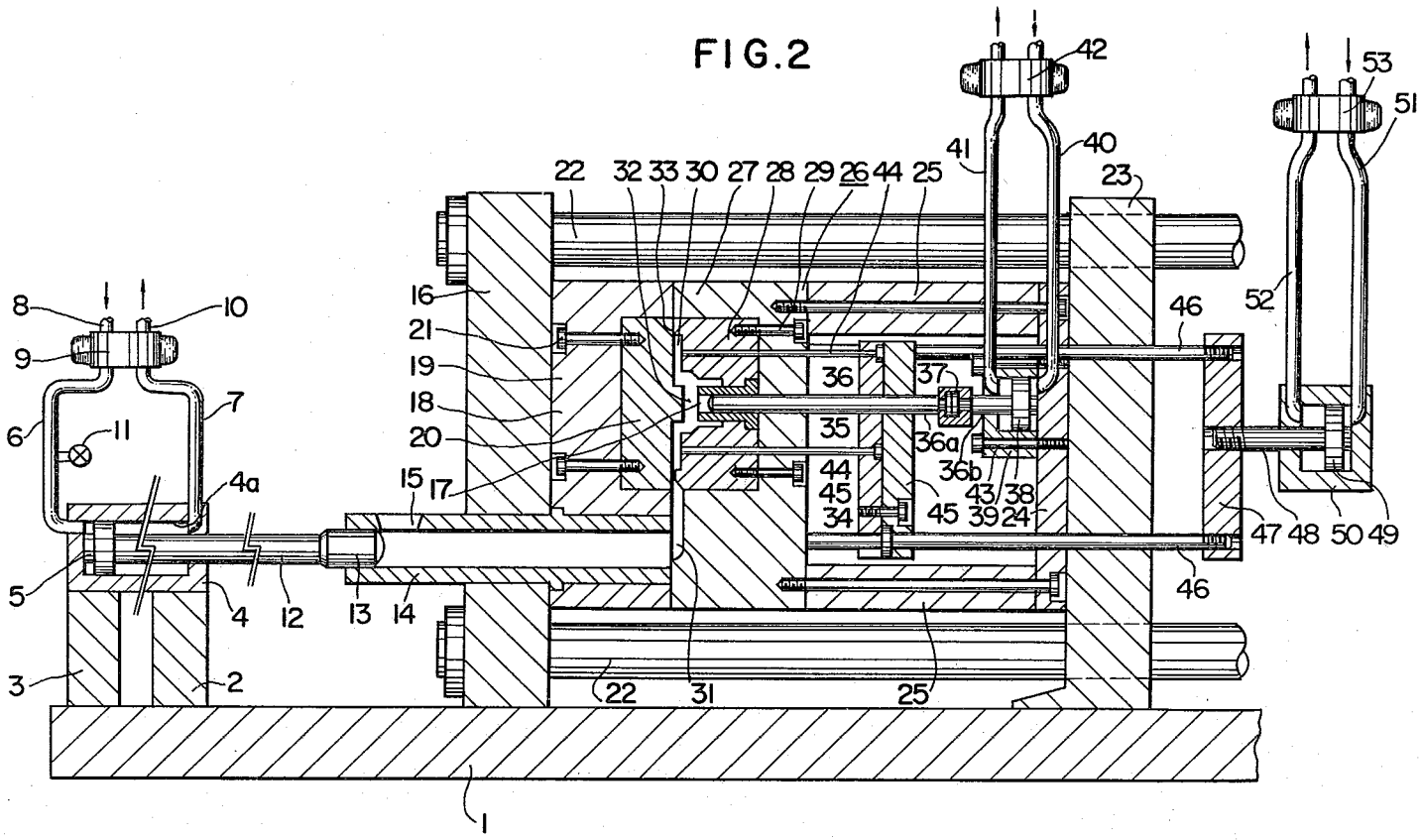
FIG. 2 is a sectional view of an example of the apparatus for carrying out the method of the present invention.

Referring first to FIG. 2, a base 1 of the apparatus is fixedly installed on a foundation such as the floor of a factory by means of studs, not shown. Support members 2, 3 are fixed to the base 1 and stationarily support an injection cylinder 4. The injection cylinder 4 has a cylindrical inner surface 4*a* which slidably holds an injection piston 5 which is adapted to be moved right and left, as viewed in the drawing, by hydraulic signal pressure applied through first and second hydraulic signal pressure pipes 6, 7 open in the opposite ends of the injection cylinder 4.

The hydraulic signal pressures are supplied by an oil pump, not shown, through an input pipe 8 and is selectively distributed to the first and second signal pressure pipes 6, 7 by means of a solenoid-controlled hydraulic pressure switching valve 9. The oil forced out from the injection cylinder 4 by the injection piston 5 is discharged through that signal pressure pipe 6 or 7 through which the signal pressure is not applied, and is returned to the pump (not shown) via the pressure switching valve 9 and an output pipe 10. A pressure switch 11 is disposed at an intermediate portion of the first signal pressure pipe 6 and is adapted to deliver an electric signal to a hydraulic pressure switching valve 42, to be discussed later, when a predetermined pressure level (e.g. a pressure which is 50 to 80% of the maximum injection pressure to be discussed later) is exceeded by the hydraulic pressure in the first signal pressure pipe 6.

Figure 1:
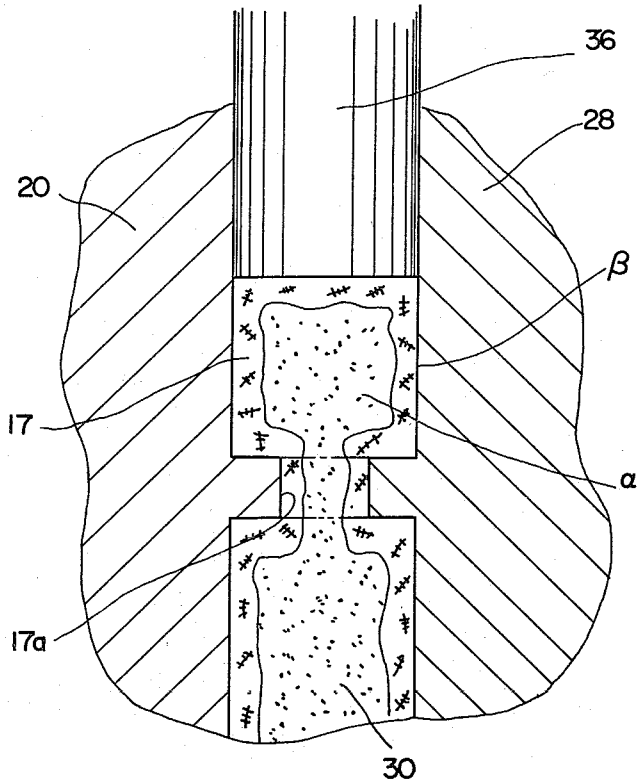
FIG. 1 is a sectional view of an essential part of an apparatus used to carry out the prior art die-casting method.

The movement of the injection cylinder rod 5 is transmitted to a plunger tip 13 through a plunger rod 12, so that the plunger tip 13 is slidably moved right and left in a shot sleeve 14, as viewed on the drawing. A pouring port 15 opens in the upper wall of the shot sleeve 14 at the point which is cleared by the plunger tip 13 in its fully retracted position (shown in FIG. 2). A molten metal, such as an aluminum alloy, magnesium alloy, zinc alloy or the like, is poured by a pouring apparatus, not shown, into the shot sleeve 14 through the puring port 15. Thus, the shot sleeve 14 constitutes a part of the injection passage through which the molten metal is injected. A fixed platen 16 is fixed to the base 1 and rigidly holds a fixed die 18. Another fixed platen is provided also at the right-hand end of a tie bar 22, although FIG. 1 shows only one fixed platen 16 located at the left-hand end of the tie bar 22. In order to obtain a minute die shape as well as to ensure easy maintenace, the fixed die 18 is constituted by two separate parts; a holding block 19 made of ductile cast iron (FCD 55) and an impression block 20 made of a hot tool steel (SKD 61). The holding block 19 and the impression block 20 are rigidly connected to each other by means of hexagon socket-headed bolts 21. The aforementioned shot sleeve 14 extends through the fixed platen 16 and the holding block 19 and opens in one end face of the latter.

Two tie bars 22 are fixed to each of the upper and lower portions of the fixed platens 16. These tie bars 22 extend through a movable platen 23. The movable platen 23 are snugly and slidably received on tie bars 22 and are adapted to be moved along the base 1 to the right and left as viewed in the drawing by a driving power of a piston not shown.

A movable die 26 is fixed to the movable platen 23 through a side fixing plate 24 and upper and lower fixing plates 25, 25. As is the case of the fixed die 18, the movable die 26 is composed of two parts; a movable holding block 27 made of ductile cast iron (FCD 55) and a movable core 28 made of a hot tool steel (SKD 61), which are connected to each other by means of bolts 29.

As the movable platen 23 is moved by the piston, not shown, the movable die 26 is brough into close contact with the fixed die 18. The two dies are shaped such that they define therebetween a die cavity 30 for die-casting the product, a runner 31 through which the molten metal is injected into the die cavity 30 and a squeezing passage 17 which opens to the cavity 30 at a portion of the latter remote from the runner 31. Gaps of from 0.1 mm to 0.5 mm are formed in the abutment surfaces of the fixed and movable dies 18 and 26 to define air vents 33 through which the air forced by the injected molten metal is relieved from the cavity 30. The end portion of the runner 31 adjacent to the cavity 30 is restricted to form a gate 34 so that the molten metal supplied from the runner 31 is injected into the cavity 30 at a high velocity.

A squeeze sleeve 35 is press-fitted into the central part of the movable core 28 so as to be positioned opposite substantially to the center of the die cavity 30. This squeeze sleeve 35 has a cylindrical shape and is made of a hot tool steel (SKD 61). The squeeze sleeve 35 closely and slidably receives a squeeze plunger 36 which is also made of hot tool steel (SKD 61). The aforementioned squeeze passage 17 is defined by the portion of the inner peripheral surface of the squeeze sleeve 35 extending beyond the inner end surface of the squeeze plunger 36. By the squeeze plunger 36, the molten metal filling the squeeze passage 17 is forced out to a portion of the cavity 30 opposed to the squeeze passage 17 (i.e. to a molten metal accumulation space 32). For easy maintenance, the squeeze plunger 36 is composed of two members 36*a*, 36*b* which are connected to each other by a connecting ring 37, so that only the part slidably movable in the squeeze passage 35 can be replaced.

Figure 3:
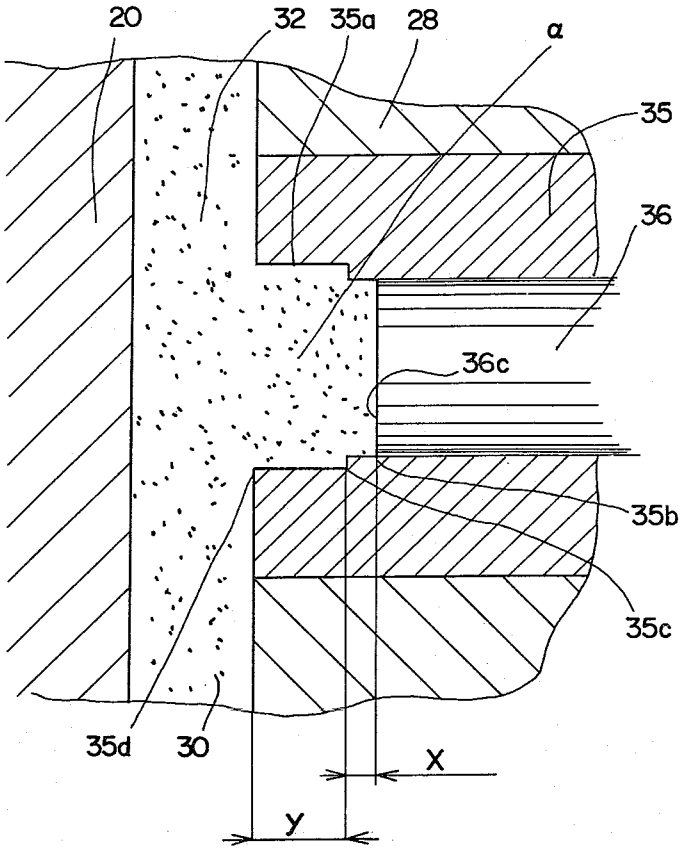
Figure 4:
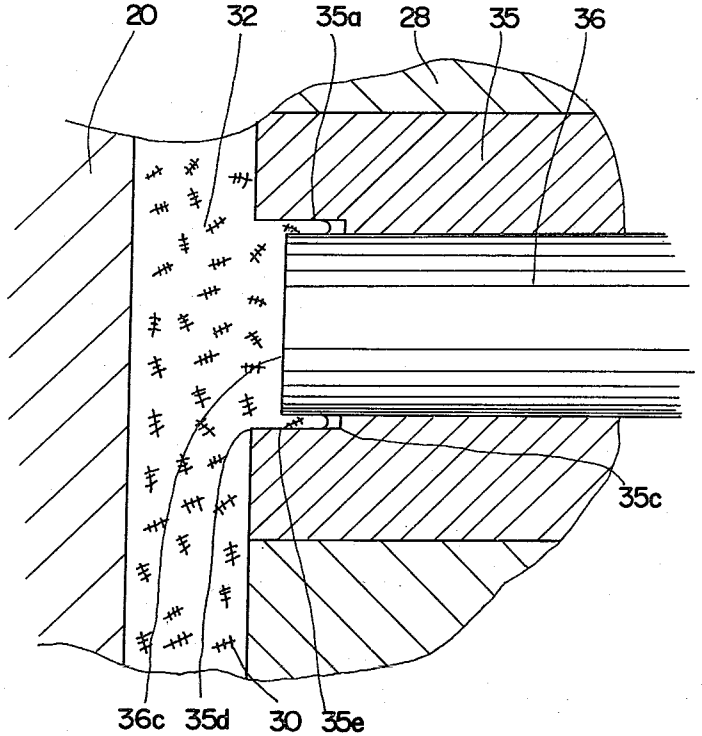

FIGS. 3 and 4 show the end portions of the squeeze sleeve 35 and the squeeze plunger 36 as well as the space 32. As will be seen in these figures, the innermost portion 35*a* of the squeeze sleeve 35 has an inner diameter which is somewhat (0.05 to 1.00 mm or so) larger than that of the other portions of the squeeze sleeve 35. When the squeeze plunger 36 is driven, the surface film of solidified layer $\beta$ formed at the surface portion of the molten metal in the squeeze passage 17 forms a ring-like fin A in the enlarged portion 35*a* of the squeeze sleeve 35 and the plunger 36 slides along the inner peripheral surface of the squeeze sleeve 17 with the fin A interposed therebetween.

The axial length y of this enlarged portion 35*a* is determined dependent on the amount of displacement of the metal effected by the squeeze plunger 36. More specifically, the enlarged portion 35*a* preferably extends to the inner end 35*d* of the squeeze sleeve 35 from a point 35*c* which is x (a distance which is not greater than 10 mm and preferably 2 to 3 mm) ahead of the position 35*b* of the end of the squeeze plunger 36 in its fully retracted position (position shown in FIG. 3). However, practically, no substantial problem is caused by increasing the length y to a point located rearwardly of the fully retracted position 35*b* of end surface of the plunger 36.

The stroke of the squeeze plunger 36 is preferably so determind that the end 36*c* of the plunger 36 does not project beyond the inner end 35*d* of the squeeze sleeve 35 even when the squeeze plunger 36 is in its fully advanced position 35*e* (shown in FIG. 4) so that it never takes place that the squeeze plunger 36 directly extends into the metal accumulation space 32. However, it has been confirmed that practically no substantial problem is caused by a slight projection of the end 36*c* of the squeeze plunger beyond the end 35*d* of the squeeze sleeve.

The term "molten metal accumulation space 32" is used in this specification to mean the portion of the die cavity corresponding to that portion of the die-cast body which is to be removed in a sixth step to be described later. This portion is actually the portion of the die cavity 30 which is opposed by the squeeze passage 17 and is so sized as to have, over the entire spatial height of the die cavity 30, a cross-sectional area which is about twice as large as the cross-sectional area of the squeeze passage 17.

A squeeze piston 38 is connected to the outer end of the squeeze plunger 36 and is adapted to slide within a squeeze cylinder 39 so as to advance and retract the squeeze plunger 36. As is the case of the injection cylinder 4, third and fourth hydraulic signal pressure pipes 40, 41 are open in the squeeze cylinder 39. A solenoid-controlled oil pressure switching valve 42 is adapted to control the transmission of the signal pressure form an oil pump (not shown) to the signal pressure pipes 40, 41 thereby to control the movement of the squeeze plunger 38. This squeeze cylinder 39 is fixed to the fixing plate 24 by means of bolts 43 so that the cylinder 39 is movable together with the movable die 26.

Ejector pins 44 extend through the holding block 27 and the movable core 28 and have ends which are exposed to the die cavity 30 from the surface of the movable core 28. These ejector pins are adapted to separate and eject from the movable die 26 a die-cast product solidified in the cavity 30 after the movable die 26 is retracted to open the die. These ejector pins are driven to the right and left as viewed in FIG. 2 by an ejector piston 49 and through an ejector plate 45, ejector rods 46, ejector plate 47 and an ejector actuating rod 48. The left ends of these ejector rods 46 are slidably received by respective bores (not shown) formed in the holding block 27. The ejector cylinder rod 49 is adapted to slide within an ejector cylinder 50 in which are opened fifth and sixth hydraulic signal pressure pipes 51, 52 as is the cases of the injection cylinder 4 and the squeeze cylinder 39. A solenoid-controlled oil pressure switching valve 53 is adapted to control the hydraulic signal pressure from an oil pump (not shown) thereby to effect the foward and rearward movement of the ejector cylinder rod 50.

Hereinafter, the sequential steps of die-casting method of the invention will be described in detail.

[First Step]

The movable platen 23 is moved to the left as viewed in FIG. 2 by driving a piston which is not shown, so as to bring the movable die 26 into intimate contact with the fixed die 18, thereby to form the die cavity 30 for the die-casting of a product, runner 31, squeeze passage 17 and air vents 33.

[Second Step]

Molten metal is poured from a pouring device, not shown, through the pouring port 15 into the shot sleeve 14 and further into a part of the runner 31. Then, the oil pressure switching valve 9 is operated to direct the signal pressure to the first signal pressure pipe 6, so that the injection piston 5 (and, accordingly, the plunger tip 13) are advanced at a predetermined pressure which is determined by the level of the signal pressure. By this forward movement of the plunger tip 13, the molten metal in the shot sleeve 14 is forced into the runner 31 and is injected to fill up the die cavity 30 and the squeeze passage 17. The injection is made at a high velocity because the molten metal is accelerated when it passes through the gate 34. The level of pressure applied to the molten metal in this step (i.e., the injection pressure) is 500 to 1500 atm. The air present in the cavity 30 would cause undesirable cavities or voids in a resultant product if the air is entrapped in the molten metal at the injection stage. Therefore, a part of air stayed in the die cavity 30 is relieved through the air vents 33 disposed at predetermined points of the abutment surfaces of the movable and fixed dies 26 and 18.

[Third Step]

After the filling up of the die cavity with the molten metal, the squeeze plunger 36 is driven to forcibly displace the molten metal from the squeeze passage 17 into the space 32 before the molten metal in the gate 34 is solidified.

In the described embodiment, the timing of commencement of the movement of the squeezing plunger 36 is controlled in the following manner: Namely, when the die cavity 30 and the squeeze passage 17 have been completely filled with the molten metal, the forward movement of the injection plunger 13 is stopped with a resultant abrupt pressure rise in the first signal pressure pipe 6. Then, the pressure rise in this pipe 6 is detected by the pressure switch 11. The pressure switch 11 is adapted to deliver an electric signal to the oil pressure switching valve 42 when the pressure in the first signal pressure pipe 6 is increased beyond a predetermined pressure level. The oil pressure switching valve 42 then switches the transmission of the signal pressure to the third signal pressure pipe 40. It will be understood that, with the above-stated arrangement, it is possible to actuate the squeeze plunger 36 promptly (usually about 0.5 second or so) after the completion of the injection.

With the die-casting machine having the above-described construction, it usually takes about 5 to 6 seconds for the molten metal in the gate 34 to be solidified completely. Thus, according to the described embodiment of invention, the forward movement of the squeeze plunger 36 is commenced in a period of time which is sufficiently short as compared with the time required for the complete solidification of the molten metal in the gate 34.

By this forward movement of the squeeze plunger 36, the molten metal in the squeeze passage 17 is forcibly displaced back into the molten metal accumulation space 32 to effect a squeeze on the molten metal in the die cavity 30.

This squeeze is continued until at least the metal in the die cavity 30 is completely solidified, i.e., the metal in the apparatus on the side of the gate 34 adjacent to the die cavity 30 is completely solidified.

It is to be noted that, since the metal in the gate 34 has not been solidified yet up to the moment at which the squeezing action is commenced, the amount of the squeezing displacement has to be large enough to make up not only for the solidification shrinkage of the metal in the die cavity 30 and in the squeeze passage 17, but also for the solidification shrinkage of the metal in the runner 31 and the shot sleeve 14 produced up to the moment when the metal is solidified in the gate 34.

Figure 5:
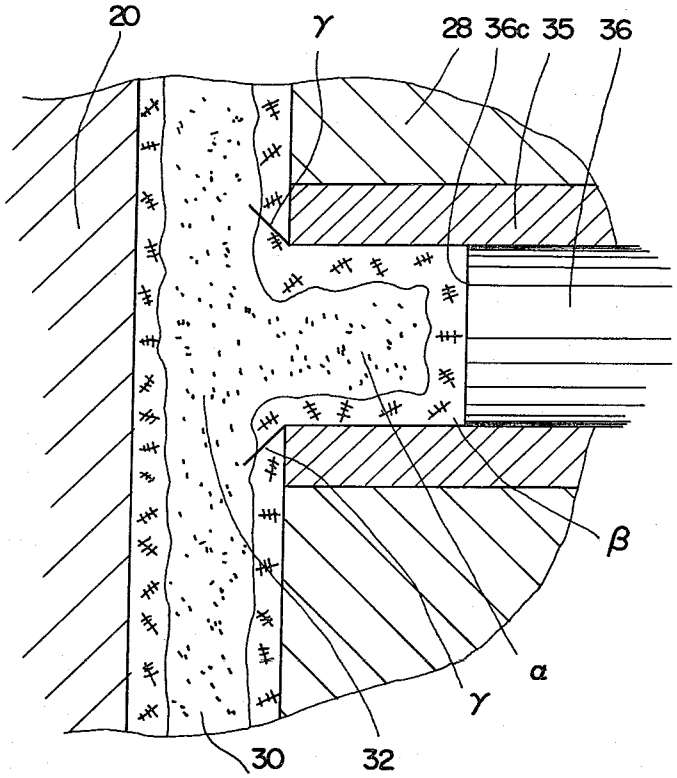
FIG. 5 is a sectional view illustrating a solidified layer $\beta$ formed in the squeeze passage 17 and in other portions.

The minimum squeezing pressure should be at least high enough to force the part $\alpha$ of molten metal from the squeeze passage 17 into the space 32. This minimum pressure must be higher than the injection pressure exerted by the injection plunger tip 13, by a value which corresponds to the sum of the frictional resistance produced by the friction caused between the inner wall of the squeeze sleeve 35 and the solidified layer $\beta$ (See FIG. 5) in the squeeze passage 17 during the forward movement of the squeeze plunger 36, and of the resistance produced as a result of the shearing deformation of the solidified layer $\beta$ formed at the inner end 35*d* of the inner peripheral surface of the squeeze sleeve 35. On the other hand, the upper limit or maximum allowable pressure is the pressure which is highest within such a range of pressure as would not cause a backward movement of the injection plunger tip 13. The pressure actually transmitted to the injection plunger tip 13 is lower than the pressure Pa imparted by the squeeze plunger 36, by a pressure corresponding to the pressure drop $\Delta P$ caused when the molten metal passes through the gate 34 and other part. Therefore, this pressure may be of such a level as not to shear the solidified layer $\beta$ formed around the forward end of the injection plunger tip 13.

The amount of squeezing displacement of metal and the squeezing pressure are selected to fall within the ranges described above. It is to be noted that, according to the present invention, a squeezing pressure of a predetermined level is always obtainable due to the fact that the die cavity 30 is so shaped that the cross-section of the die cavity taken through the portion thereof communicating with the squeeze passage 17 and in a direction perpendicular to the direction of movement of the squeeze plunger 36 is of an area greater than the cross-section of the inner bore of the squeeze sleeve 35.

More specifically, in the method of the invention, the molten metal $\alpha$ is displaced by the squeeze plunger 36 from the squeeze passage 17 into the die cavity 30 (space 32) while the displaced metal forms a diverging flow. Therefore, the resistance produced by the presence of the solidified layer $\beta$ during the forward movement of the squeeze plunger 36 is only a total resistance produced by the friction between the solidified layer $\beta$ and the inner peripheral surface of the squeeze sleeve 35 and the force required for shearing the solidified layer $\beta$ formed on the inner peripheral surface of the end of the squeeze sleeve 35. The friction resistance can simply be determined if the inner diameter of the squeeze sleeve 35 and the stroke of the squeeze plunger 36 are given. The shearing force can also be simply determined because the shearing of the solidified layer $\beta$ takes place always at the end 35 of the inner peripheral surface of the squeeze sleeve 35 and the thickness of the shearing plane is always substantially constant.

Therefore, if the squeezing pressure is set within the aforementioned range, an equal squeezing pressure is exerted to the molten metal in each die-casting operation according to the method of the invention, whereby die-cast product of excellent quality can always be obtained.

[Fourth Step]

After the injected metal on the side of the gate 34 adjacent to the die cavity 30 is solidified, any further application of pressure by the squeeze plunger 36 will not be effective to squeeze the metal. Thus, the oil pressure switching valve 42 is operated to feed the signal pessure now to the fourth signal oil pressure pipe 41 thereby to retract the squeeze plunger 36.

The time required for the solidification of the metal in the die cavity 30 varies with the volume and spatial height of the die cavity. It is therefore preferred to experimentally retract the squeeze plunger 36 at various timings to preliminarily measure the time required for the solidification and to operate the oil pressure switching valve 42 by means of a timer after the elapse of a time period which is the sum of the above measured time and a predetermined additional time (which may be 1 or 2 seconds).

[Fifth Step]

After the retraction of the squeeze plunger 36, the piston not shown in actuated to move the movable platen 23 to the right as viewed in FIG. 2 to separate the movable die 26 from the fixed die 18. The separation of the movable die 26 may be made at such a timing when the outer surface of the molten metal on the side of the injection passage has been solidified to such an extent as to maintain the shape of the die-cast product. In the described embodiment, the movable die 26 is separated at a timing of 0.5 to 1 second after the retraction of the squeeze plunger 36.

The pressure signal applied to the first signal pressure pipe 6 is still maintained when the movable die 26 is separated, so that a die-cast product solidified in the shot sleeve 14 may be forced out therefrom.

Then, the signal pressure is switched to the second signal pressure pipe 7 by the oil pressure switching valve 9 thereby to retract the injection plunger tip 13. Subsequently, the pressure switching valve 53 is operated to switch the signal oil pressure to the fifth signal pressure pipe 51 so as to move the ejector piston 49 to the left as viewed in FIG. 1. This leftward movement of the ejector piston 49 is transmitted to the ejector pins 44 through the ejector actuating rod 48, ejector plate 47, ejector rods 46 and the ejector plate 45. As a result, the die-cast product which has been solidified in the die cavity 30, the runner 31 and the squeeze passage 17 is ejected by the ejector pins 44.

[Sixth Step]

Figure 6:
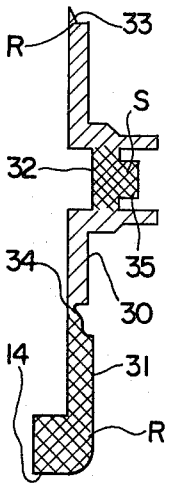
FIG. 6 is a sectional view of a die-cast article produced by the apparatus shown in FIG. 1.
Figure 7:
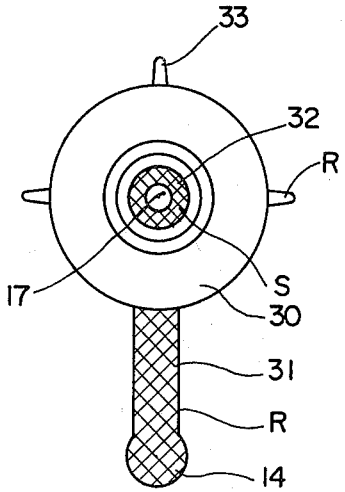
FIG. 7 is a side elevational view of the article shown in FIG. 6.

The product obtained by this die-casting method has a shape as shown in FIGS. 6 and 7. After the die-casting, the portions which have been solidified in the shot sleeve 14, the runner 31 and the air vents 33 (hatched portions R in FIGS. 6 and 7) are cut away by a press. Then, the portion of the die-cast body solidified in the molten metal accumulation space 32 (hatched portion S in FIGS. 6 and 7) is cut by a lathe from the die-cast body from which the portions solidified in the shot sleeve 14, runner 31 and air vents 33 have already been removed, thus providing a finished die-cast product. The removal of part S is effected in the squeezing direction of the squeeze passage, i.e., from right to left in FIG. 6, meaning that the removal of part S is from its right hand end face which was adjacent the squeeze passage through to its opposite end face.

The portion solidified in the molten metal accumulation space 32 is removed for the following reason.

In the space 32, the solidification proceeds under the squeezing pressure applied directly by the squeeze plunger 36. Therefore, the solidified layer $\beta$ formed in the space 32 is subjected to shearing before it grows sufficiently, with a resultant production of a surface defect which undersirably lowers the mechanical strength of the die-cast product. In addition, since different time periods are needed for the crystallization of different metal components of the molten metal, the metal component which has been crystallized first remains in the space 32 whereas the other metal component or components which are still in liquid phase are forced out of the space 32 by the pressure exerted by the squeeze plunger 32, which tends to produce a segregation which adversely affects the workability (particularly, cutting) of the die-cast product and makes the precision working difficult.

Figure 8:
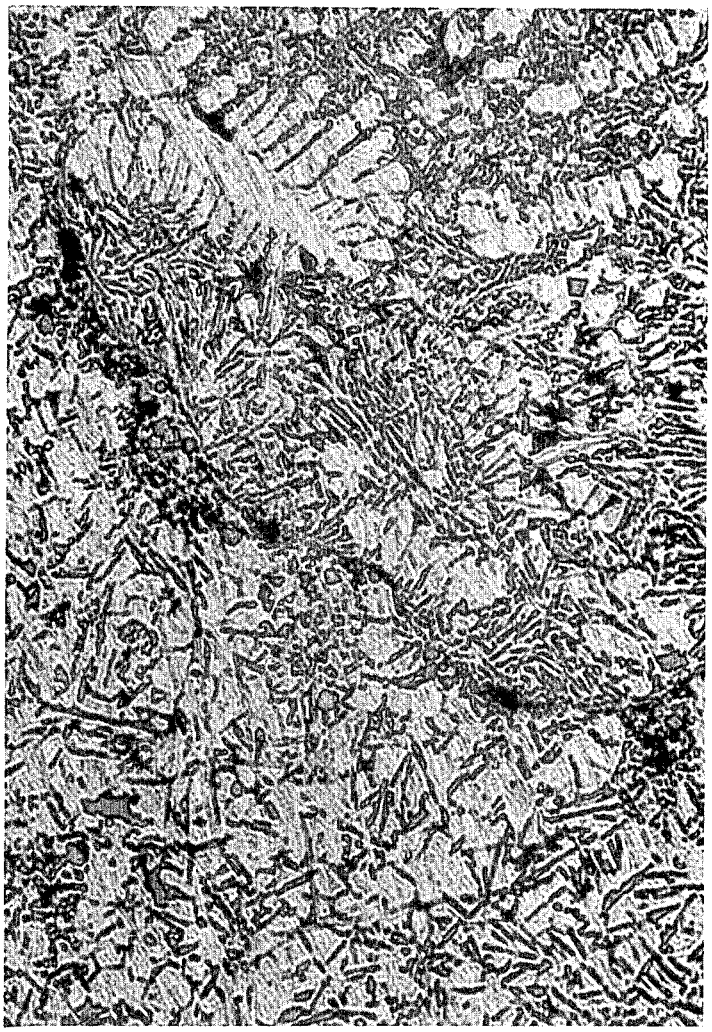
FIG. 8 is a photograph showing the structure of a die-cast product with surface defects.
Figure 9:
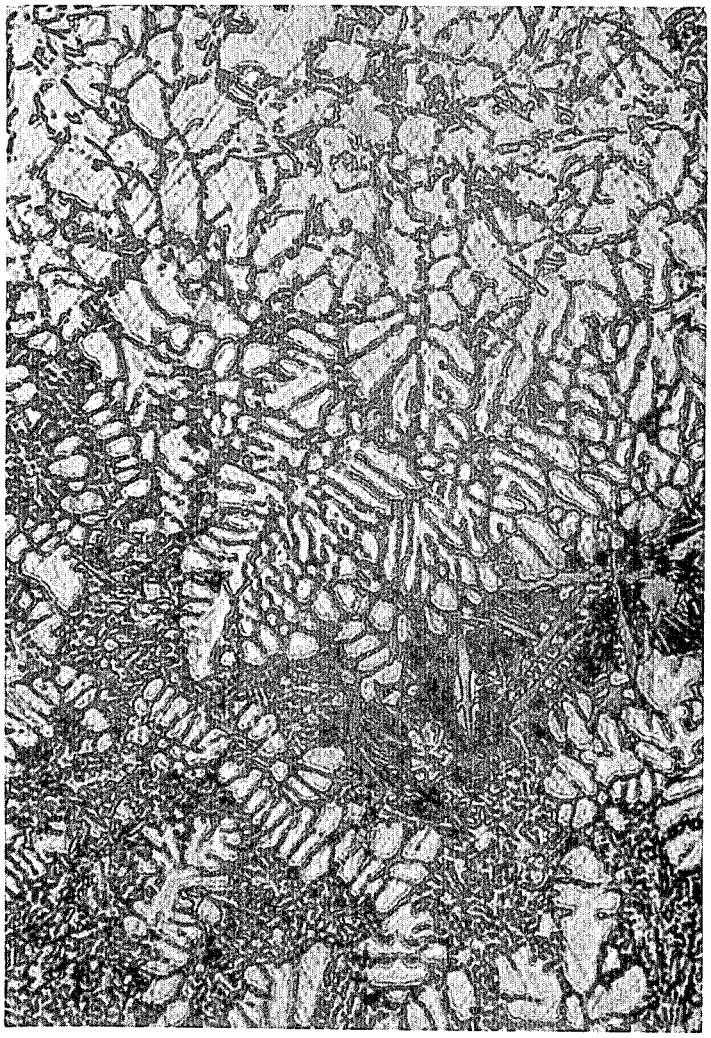
FIG. 9 is a photograph showing the structure of a die-cast product with segregation.

FIGS. 8 and 9 are photographs which respectively show the structure of a die-cast body with a surface defect and the structure of another die-cast body with segregation. These structures were both found in those portions of the die-cast bodies which were solidified in the molten metal accumulation space 32.

Therefore, in die-casting articles which are particularly intended for operation under a high pressure or must be precisely worked, it will be necessary to remove the portions of die-cast bodies which are solidified in the molten metal accumulation space 32. The die-cast article shown in FIGS. 6 and 7 is intended for use as a side housing of a rotary machine. In this case, the bore formed as a result of the removal of the portion solidified in the space 32 is advantageously used as the bore for receiving a rotor shaft of the machine.

Figure 10:
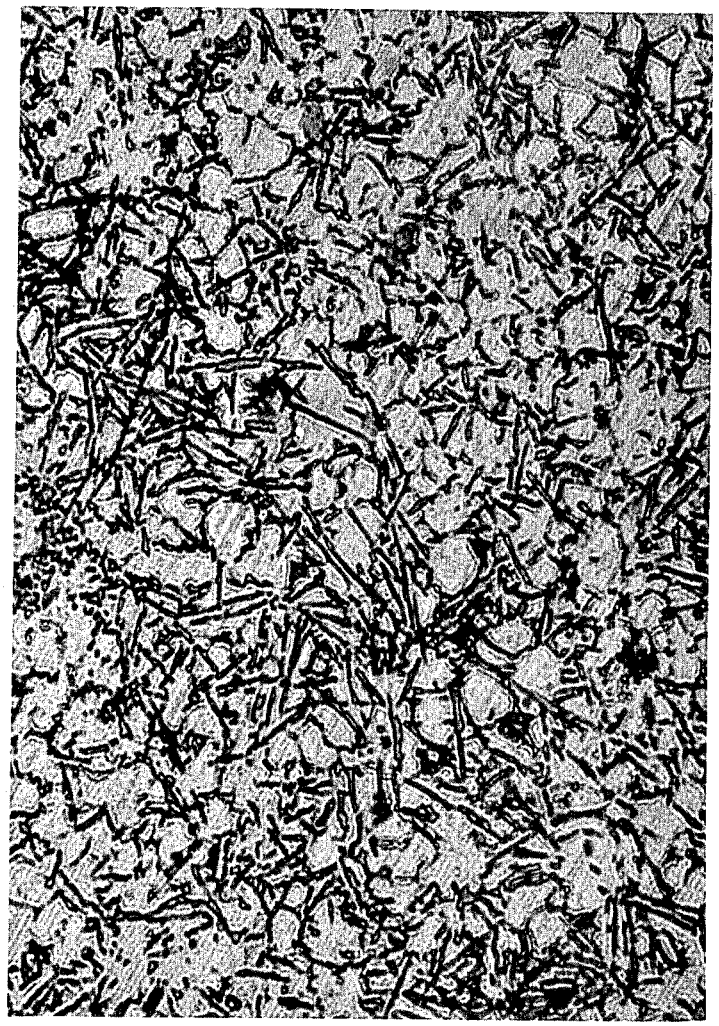
FIG. 10 is a photograph showing the structure of a die-cast article produced by the method of the present invention.

The metal in the portions of the die cavity 30 other than the molten metal accumulation space 32 is not directly squeezed by the squeeze plunger 36 and, thus, is free from any surface defect and segregation. FIG. 10 is a photograph showing the structure of the die-cast product solidified in a portion of the die cavity 30 other than the molten metal accumulation space 32. It will also be seen from FIG. 10 that the die-cast product produced in accordance with the die-casting method of the invention is completely free from voids or cavities, surface defects and segregations.

As a matter of course, it is not essential for the invention that the squeeze plunger 36 used to carry out the method of the invention must be disposed in the movable die 26. The squeeze plunger may alternatively be installed in the fixed die 18 or, further alternatively, may be so disposed as to be slidable along the abutment surfaces of the movable and fixed dies 26 and 18.

INDUSTRIAL APPLICABILITY

According to the invention, the molten metal in the die cavity can be squeezed always at a stable squeezing pressure, with resultant die-cast products which are completely free from undesirable surface defects and segregations which would adversely affect the strength and workability of the products. Therefore, the die-casting method of the invention can effectively be used in the mass-production of articles which are used under a high pressure or articles which have to be precisely worked. For instance, the method of the invention can suitably be used in the mass-production of housings of compressors or pumps.

We claim:

1. A die-casting method comprising:

a first step of relatively moving dies into close contact so as to form therebetween a die cavity for casting a product, a runner through which molten metal is injected into said die cavity, and a substantially non-narrowing squeeze passage connected directly to said die cavity at a point other than the point of connection between said die cavity and said runner;

a second step of injecting, by forwardly moving an injection plunger to effect a predetermined injection pressure, the molten metal from said runner via a gate into said die cavity and said squeeze passage to fill said die cavity and said squeeze passage with the molten metal;

a third step of starting a squeezing displacement of the molten metal in said non-narrowing squeeze passage by moving a squeeze plunger through said squeeze passage from a position therein remote from said die cavity toward said die cavity and at a predetermined squeezing pressure greater than said injection pressure and at a time before said gate is blocked by solidified molten metal;

continuing the squeezing on said molten metal by said squeeze plunger in said passage at said predetermined squeezing pressure until said cavity is filled voidlessly and, during said continued squeezing, forcing molten metal out of said die cavity through said gate into said runner by the molten metal displaced out of said squeeze passage by said squeeze plunger and until the molten metal is completely solidified at least in said die cavity while retaining said squeeze plunger substantially fully inside said passage to produce a solidified voidless die-cast product;

preventing said injection plunger from being moved backward during said third step and continued squeezing by the effect of said greater pressure applied by said squeeze plunger;

a fourth step of retracting said squeeze plunger to remove said squeezing pressure from said squeeze passage after the molten metal is solidified in said die cavity;

a fifth step of relatively moving said dies away from one another including removing therefrom the die-cast body which has been solidified in said die cavity, runner and squeeze passage; and a sixth step of removing from said die-cast body the portions thereof which have been solidified in said runner and squeeze passage and also removing, from the portion of the die-cast body solidified in the die cavity, the part of the die-cast body generally opposing said squeeze passage, the removal of said die-cast body part being effected in the squeezing direction of the squeeze plunger, said part having a cross-sectional area greater than the cross-sectional area of the squeeze passage.

2. A die-casting method as in claim 1 wherein said squeeze passage formed by said first step is so located as to be communicated with said die cavity at a substantially central point of said die cavity.

3. A die-casting method comprising:

a first step of relatively moving dies into close contact with one another so as to form therebetween a die cavity for casting a product, a runner connected to said die cavity by a gate, and a substantially non-narrowing squeeze passage communicated with said die cavity at a point other than the point of connection between said die cavity and said runner;

a second step of injecting, by an injection plunger and at a predetermined injection pressure, the molten metal from said runner via said gate into said die cavity and said squeeze passage to fill said die cavity and said squeeze passage with the molten metal;

a third step of starting a squeezing displacement of the molten metal in said squeeze passage by moving a squeeze plunger from a position in said passage remote from said die cavity toward said die cavity and at a predetermined squeezing pressure greater than said predetermined injection pressure and at a time before said gate is blocked by solidified molten metal;

continuing the squeezing on said molten metal by said squeeze plunger at said predetermined squeezing pressure to fill said cavity with molten metal and, during said continued squeezing, forcing molten metal out of said die cavity through said gate into said runner until the molten metal is completely solidified at least in said die cavity while retaining said squeeze plunger substantially fully inside said passage to produce a solidified voidless die-cast product;

preventing said injection plunger from being moved backward by the effect of said greater pressure applied by said squeeze plunger during said third step and continued squeezing;

a fourth step of retracting said squeeze plunger to remove said squeezing pressure from said squeeze passage after the molten metal is solidified in said die cavity;

a fifth step of relatively moving said dies away from one another including removing therefrom the die-case body which has been solidified in said die cavity, runner and squeeze passage; and a sixth step of removing from said die-cast body the portions thereof which have been solidified in said runner and squeeze passsage and also removing, from the portion of the die-cast body solidified in the die cavity, the part of the die-cast body generally opposing said squeeze passage, the removal of said die-cast body part being effected in the squeezing direction of the squeeze plunger, said part having a cross-sectional area greater than the cross-sectional area of the squeeze passage.

4. A die-casting method as in claim 3 wherein said squeeze passage formed by said first step is so located as to be communicated with said die cavity at a substantially central point of said die cavity.

5. A die-casting method comprising:

a first step of relatively moving dies into close contact with one another so as to form therebetween a die cavity for casting a product, a runner connected to said die cavity by a gate and through which molten metal is injected into said die cavity, and a substantially non-narrowing squeeze passage communicated with said die cavity at a point other than the point of connection between said die cavity and said runner;

a second step of injecting, by an injection plunger operated in a sleeve connected to said die cavity by said runner and gate and at a predetermined injection pressure, the molten metal from said runner via said gate into said die cavity and said squeeze passage to fill said cavity and passage with the molten metal;

a third step of starting a squeezing displacement of the molten metal in said squeeze passage by moving a squeeze plunger from a position in said passage remote from said die cavity toward said die cavity and at a predetermined squeezing pressure and at a time before said gate is blocked by solidified molten metal;

continuing the squeezing on said molten metal by said squeeze plunger at said predetermined squeezing pressure to fill said cavity with molten metal and, during said continued squeezing, forcing molten metal out of said die cavity through said gate into said runner until the molten metal is completely solidified at least in said die cavity to produce a solidified die-cast product;

said predetermined squeezing pressure being:

(A) greater than the sum of the injection pressure, a sliding frictional resistance generated during the movement of said squeeze plunger and a resistance generated during a shearing deformation of a solidified layer formed at the forward end of the inner peripheral surface of said squeeze passage, but (B) less than the total of said sum and a resistance generated during a shearing deformation of a solidified layer formed in front of said injection plunger;

preventing said injection plunger from being moved back by the effect of the pressure applied by said squeeze plunger during said third step and continued squeezing;

a fourth step of retracting said squeeze plunger to remove said squeezing pressure from said squeeze passage after the molten metal is solidified in said die cavity;

a fifth step of relatively moving said dies away from one another including removing the die-cast body which has been solidified in said die cavity, runner and squeeze passage; and a sixth step of removing from said die-cast body the portions thereof which have been solidified in said runner and squeeze passage and also removing, from the portion of the die-cast body solidified in the die cavity, the part of the die-cast body generally opposing said squeeze passage, the removal of said die-cast body part being effected in the squeezing direction of the squeeze plunger, said part having a cross-sectional area greater than the cross-sectional area of the squeeze passage.

6. A die-casting method as in claim 5 wherein said squeeze passage formed by said first step is so located as to be communicated with said die cavity at a substantially central point of said die cavity.

7. A die-casting method as claimed in claim 1, 3 or 5, wherein the removal, in said sixth step, of said part is effected through the die-cast body portion solidified in said die cavity, from the end face of said die-cast body portion adjacent to said squeeze passage to the opposite end face of said die-cast body portion.

8. A die-casting method as claimed in claim 7, wherein said squeeze passage formed by said first step is so located as to be communicated with said die cavity at a substantially central point thereof.

* * * * *